US010982844B2

(12) United States Patent
Moore et al.

(10) Patent No.: US 10,982,844 B2
(45) Date of Patent: Apr. 20, 2021

(54) POOLSIDE BURNER

(71) Applicant: Pebble Technology, Inc., Scottsdale, AZ (US)

(72) Inventors: Taylor James Moore, Chandler, AZ (US); Dylan Garrett Pratt, Gilbert, AZ (US)

(73) Assignee: PEBBLE TECHNOLOGY, INC., Scottsdale, AZ (US)

( * ) Notice: Subject to any disclaimer, the term of this patent is extended or adjusted under 35 U.S.C. 154(b) by 17 days.

(21) Appl. No.: 16/508,881

(22) Filed: Jul. 11, 2019

(65) Prior Publication Data

US 2020/0018477 A1 Jan. 16, 2020

Related U.S. Application Data

(60) Provisional application No. 62/696,654, filed on Jul. 11, 2018.

(51) Int. Cl.

| | |
|---|---|
| ***F23D 14/06*** | (2006.01) |
| ***F23D 14/08*** | (2006.01) |
| ***F23D 14/58*** | (2006.01) |
| ***F23D 14/32*** | (2006.01) |

(52) U.S. Cl.
CPC ..... *F23D 14/06* (2013.01); *F23D 14/085* (2013.01); *F23D 14/58* (2013.01); *F23D 14/32* (2013.01); *F23D 2900/14* (2013.01)

(58) Field of Classification Search
CPC ..... F23D 4/06; F23D 4/085; F23D 4/58
USPC ..... 126/39 R, 500, 512, 519; 431/353, 8, 431/125, 126
See application file for complete search history.

(56) References Cited

U.S. PATENT DOCUMENTS

| | | | | |
|---|---|---|---|---|
| 2,542,335 A * | 2/1951 | Kapit | A47J 37/06 | 99/393 |
| 6,354,288 B1 * | 3/2002 | McDonald | F24C 1/16 | 126/500 |
| 6,769,907 B2 * | 8/2004 | Doud | F23D 99/00 | 126/519 |

* cited by examiner

*Primary Examiner* — Vivek K Shirsat
(74) *Attorney, Agent, or Firm* — Booth Udall Fuller, PLC

(57) ABSTRACT

A poolside burner having a central gas feed and a burner ring having longitudinally-oriented slit-like flame orifices. The burner ring is securely attached to a burner plate having a centralized hole through which a feeder extends and mates with a central distribution tube connected to the burner ring.

20 Claims, 5 Drawing Sheets

POOLSIDE BURNER

CROSS REFERENCE TO RELATED APPLICATIONS

This application claims the benefit of U.S. Provisional Patent No. 62/696,654, entitled "Poolside Burner," which was filed on Jul. 11, 2018, the disclosure of which is hereby incorporated by reference in its entirety

TECHNICAL FIELD this document relate generally to poolside burners configured to burn gas to produce heat and flame, and more specifically to poolside burner having a central gas feed and a burner ring having longitudinally-oriented slit-like flame orifices.

BACKGROUND

Poolside burners are generally used to decorate areas near swimming pools and other outdoor areas, providing heat and aesthetic views to people in the vicinity. Ordinarily, poolside burners burn gas, which is typically supplied to a tube on the underside of the burner and conventionally split to two different valves, wherein one valve supplies gas to a pilot light and the other valve supplies gas to the rest of the burner and is only turned on when the burner is to be lit. When turned on, the second valve fills a burner ring having flame orifices, through which the gas escapes and is ignited by the pilot light, thereby causing flame to rise from the burner ring in a pattern matching the shape of the burner ring. The pilot light must be lit for the burner to operate, thereby constantly consuming gas and requiring additional burner components. If the pilot light flames-out or is turned off, then it must be reignited before the burner can be used. Most conventional burners use hot surface ignition to light the pilot light. This requires a significant amount of electricity to heat up the ignitor, so that gas near the ignitor can be lit. Common poolside burners also often include a flame sensor which can sense whether the pilot light is lit or not. However, in circumstances in which wind is present, the pilot light may be blown to the side slightly. The flame sensor may then fail to sense the flame, and send a signal that the pilot light has gone out. The burner may then try to restart the pilot light as outlined above, leading to further wasted gas and electricity.

Conventionally, gas is supplied to a poolside burner through a tube that connects directly with the burner ring. Therefore, more gas may escape through flame orifices that are closer to this direct connection than escapes through flame orifices that are further from the direct gas connection, such as on a side of the burner ring opposite the connection. A direct connection design may lead to flames that are larger and brighter on one side of the burner than the other. In addition, conventional poolside burners often operate with retaining brackets which secure the burner ring and restrict it from shifting on the top of a burner plate. However, typical retaining brackets usually extend primarily upward from the burner plate. Therefore, if forces are applied to the burner ring, such as if the burner is lifted by the burner ring or is somehow bumped and experiences an angular force, the retaining brackets may break and the burner ring may dislodge. Accordingly, there is a need for an improved poolside burner.

SUMMARY

In an aspect of the present disclosure, a poolside burner may comprise a multi-layered burner plate having a top metallic layer, a bottom metallic layer, and at least one layer of insulating material sandwiched between the top metallic layer and the bottom metallic layer, wherein the multi-layered burner plate may include an opening located at a symmetrical center of the multi-layered burner plate, and wherein the symmetrically-centered opening may extend through all layers of the multi-layered burner plate. A gas feeder tube may be positioned to extend through the symmetrically-centered opening of the multi-layered burner plate, wherein a valve may control gas entry into the feeder tube. A center distribution tube may be connected to the gas feeder tube at a location proximate a lengthwise middle of the center distribution tube. A burner ring may be connected to the center distribution tube at opposing distal ends of the center distribution tube, wherein a bottom portion of the burner ring may be positioned near the top metallic layer of the multi-layered burner plate, a top portion of the burner ring may be located at a farthest extent from the top metallic layer of the multi-layered burner plate, an inside portion of the burner ring may be oriented to face the center distribution tube, and an outside portion of the burner ring may be located opposite the inside portion of the burner ring. The burner ring may include at least two flame orifices located on the outside portion of the burner ring, wherein the at least two flame orifices may be slit-like and configured so that the general extent of each of the at two slit-like flame orifices runs in a direction oriented longitudinally along the outside portion of the burner ring. The burner ring may also include at least two vertical walled sections located on the outside portion of the burner ring, wherein the at least two vertical walled sections may be separately positioned between the at least two slit-like flame orifices. Embodiments of a poolside burner may further comprise at least two wrap brackets. Each of the at least two wrap brackets may be configured to securely attach to the multi-layered burner plate and wrap around and restrain a portion of the center distribution tube in a manner wherein one of the at least two wrap brackets may wrap around a side of the center distribution tube and the other of the at least two wrap brackets may wrap around an opposite side of the center distribution tube. A direct spark igniter may be located so that a spark emanating from the igniter extends near one of the at least two slit-like flame orifices to ignite gas permeating from the orifice and light the burner. Moreover, a flame sensor may be located separate from the direct spark igniter along the outside portion of the burner ring and near one of the at least two slit-like flame orifices. The flame sensor may be configured to detect if there is a flame projecting from the slit-like flame orifice near the flame sensor. Embodiments of a poolside burner may also comprise at least two cages, wherein one cage of the at least two cages may be secured to the multi-layered burner plate and located so as to be positioned around the direct spark igniter and the other cage of the at least two cages may be secured to the multi-layered burner plate and located so as to be positioned around the flame sensor.

Particular aspects of the poolside burner may include a center distribution tube and a burner ring comprised of square tubing having a square-like cross-section. The center distribution tube and the burner ring may also be comprised of circular tubing having a circular cross-section. The burner ring may be polygonal-shaped and may have an even number of sides, or the burner ring may be circular shaped. In addition, at least one of the at least two vertical walled sections is located on the outside portion of the burner ring at a position proximate where an end of the center distribution tube connects to the burner ring. The valve that controls gas entry into the feeder tube may be located on the bottom side of the multi-layered burner plate. A direct spark igniter may be located proximate where an end of the center distribution tube connects to the burner ring and where gas from the center distribution tube initially permeates through a nearest slit-like flame orifice. The poolside burner may further comprise a pilot light.

In another aspect, a poolside burner may comprise a burner ring connected to opposite ends of a center distribution tube, wherein the center distribution tube may be connected to a feeder tube that extends through a central opening of a burner plate to which the burner ring may be secured by a bracket that, at least partially, wraps around the center distribution tube and is attached to the burner plate. A direct spark igniter may be positioned near a slit-like flame orifice of the burner ring running longitudinally about a portion of an outside surface of the burner ring, wherein the slit-like flame orifice may be located and configured so that flame extends substantially perpendicularly from the slit-like flame orifice after the direct spark igniter lights the poolside burner.

Particular aspects of the poolside burner may comprise a flame sensor positioned near a portion of the slit-like flame orifice separate from the direct spark igniter and configured to sense whether a flame is permeating from the slit-like flame orifice after the direct spark igniter lights the poolside burner. The burner plate may be comprised of multiple layers, wherein one of the layers is formed of an insulating material. Furthermore, the poolside burner may comprise two cages, wherein one of the two cages partially surrounds the direct spark igniter and the other of the two cages partially surrounds the flame sensor. The central opening of the burner plate is centered symmetrically with respect the configuration of the burner plate. In addition, the poolside burner may comprise a plurality of slit-like flame orifices, wherein a respective number of vertical walled sections may be separately positioned between each of the slit-like flame orifices of the plurality of slit-like flame orifices. Still further, the poolside burner may comprise at least one more bracket, wherein the at least one more bracket may, at least partially, wrap around the center distribution tube and is attached to the burner plate.

In an aspect, a poolside burner may also comprise a burner plate having a layer of insulating material sandwiched between top and bottom metallic layers, wherein the burner plate may include an opening that extends through all layers of the burner plate. A gas feeder tube may be positioned to extend through the opening of the burner plate. A center distribution tube may be connected to the gas feeder tube. A burner ring may be connected to the center distribution tube at opposing distal ends of the center distribution tube. The burner ring may include a slit-like flame orifice located on a radially outermost portion of the burner ring, wherein the slit-like flame orifice may be positioned longitudinally along the radially outermost portion of the burner ring. The burner ring may also include a vertical walled section located on the radially outermost portion of the burner ring. Embodiments of a poolside burner may further comprise a wrap bracket configured to attach to the burner plate and restrain a portion of the center distribution tube. A direct spark igniter may be located to ignite gas permeating from the slit-like flame orifice and a flame sensor may be located separate from the direct spark igniter along the slit-like flame orifice.

Particular aspects of the poolside burner may comprise a plurality of slit-like flame orifices positioned longitudinally along the radially outermost portion of the burner ring. A valve may be configured to control a flow of gas into the gas feeder tube. At least a portion of the vertical walled portion may be located on the radially outermost portion of the burner ring proximate a location where the center distribution tube connects to the burner ring to facilitate deflection of gas emanating from the center distribution tube so that the gas travels around the burner ring and more evenly distributes itself throughout the burner ring prior to permeation from the slit-like flame orifice.

Aspects and applications of the disclosure presented here are described below in the drawings and detailed description. Unless specifically noted, it is intended that the words and phrases in the specification and the claims be given their plain, ordinary, and accustomed meaning to those of ordinary skill in the applicable arts. The inventors are fully aware that they can be their own lexicographers if desired. The inventors expressly elect, as their own lexicographers, to use only the plain and ordinary meaning of terms in the specification and claims unless they clearly state otherwise and then further, expressly set forth the "special" definition of that term and explain how it differs from the plain and ordinary meaning. Absent such clear statements of intent to apply a "special" definition, it is the inventors' intent and desire that the simple, plain and ordinary meaning to the terms be applied to the interpretation of the specification and claims.

The inventors are also aware of the normal precepts of English grammar. Thus, if a noun, term, or phrase is intended to be further characterized, specified, or narrowed in some way, then such noun, term, or phrase will expressly include additional adjectives, descriptive terms, or other modifiers in accordance with the normal precepts of English grammar. Absent the use of such adjectives, descriptive terms, or modifiers, it is the intent that such nouns, terms, or phrases be given their plain, and ordinary English meaning to those skilled in the applicable arts as set forth above.

Further, the inventors are fully informed of the standards and application of the special provisions of 35 U.S.C. § 112(f). Thus, the use of the words "function," "means" or "step" in the Detailed Description or Description of the Drawings or claims is not intended to somehow indicate a desire to invoke the special provisions of 35 U.S.C. § 112(f), to define the invention. To the contrary, if the provisions of 35 U.S.C. § 112(f) are sought to be invoked to define the inventions, the claims will specifically and expressly state the exact phrases "means for" or "step for", and will also recite the word "function" (i.e., will state "means for performing the function of [insert function]"), without also reciting in such phrases any structure, material or act in support of the function. Thus, even when the claims recite a "means for performing the function of . . . " or "step for performing the function of . . . ," if the claims also recite any structure, material or acts in support of that means or step, or that perform the recited function, then it is the clear intention of the inventors not to invoke the provisions of 35 U.S.C. § 112(f). Moreover, even if the provisions of 35 U.S.C. § 112(f) are invoked to define the claimed aspects, it is intended that these aspects not be limited only to the specific structure, material or acts that are described in the preferred embodiments, but in addition, include any and all structures, materials or acts that perform the claimed function as described in alternative embodiments or forms of the disclosure, or that are well known present or later-developed, equivalent structures, material or acts for performing the claimed function.

The foregoing and other aspects, features, and advantages will be apparent to those artisans of ordinary skill in the art from the DESCRIPTION and DRAWINGS, and from the CLAIMS.

BRIEF DESCRIPTION OF THE DRAWINGS

The invention will hereinafter be described in conjunction with the appended drawings, where like designations denote like elements, and.

DETAILED DESCRIPTION

Figure 1:
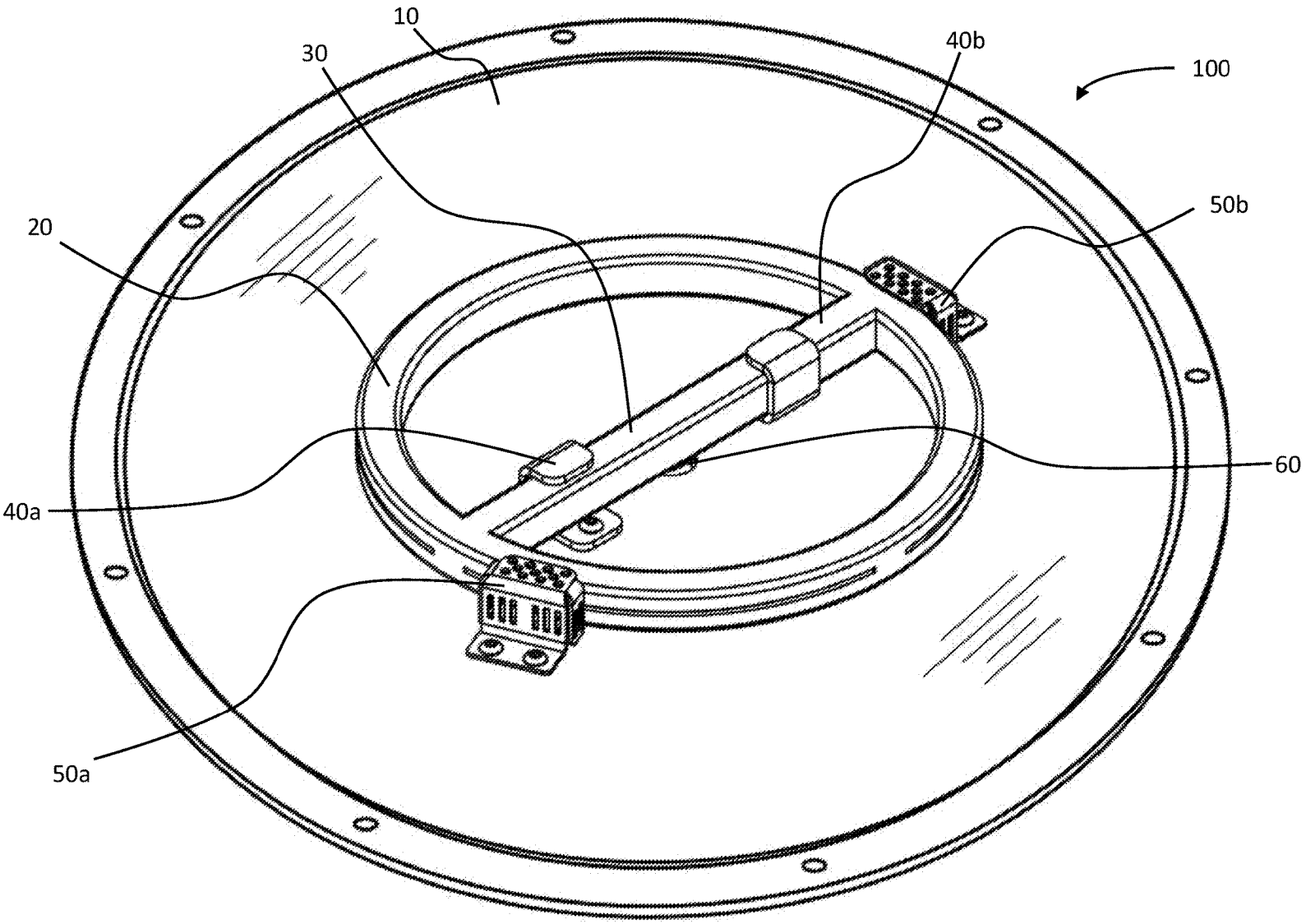
FIG. 1 is a front perspective view of an embodiment of a poolside burner.

This disclosure, its aspects and implementations, are not limited to the specific material types, components, methods, or other examples disclosed herein. Many additional material types, components, methods, and procedures known in the art are contemplated for use with particular implementations from this disclosure. Accordingly, for example, although particular implementations are disclosed, such implementations and implementing components may comprise any components, models, types, materials, versions, quantities, and/or the like as is known in the art for such systems and implementing components, consistent with the intended operation.

The word "exemplary," "example," or various forms thereof are used herein to mean serving as an example, instance, or illustration. Any aspect or design described herein as "exemplary" or as an "example" is not necessarily to be construed as preferred or advantageous over other aspects or designs. Furthermore, examples are provided solely for purposes of clarity and understanding and are not meant to limit or restrict the disclosed subject matter or relevant portions of this disclosure in any manner. It is to be appreciated that a myriad of additional or alternate examples of varying scope could have been presented, but have been omitted for purposes of brevity.

While this disclosure includes a number of embodiments in many different forms, there is shown in the drawings and will herein be described in detail particular embodiments with the understanding that the present disclosure is to be considered as an exemplification of the principles of the disclosed methods and systems, and is not intended to limit the broad aspect of the disclosed concepts to the embodiments illustrated.

A need exists for a stronger, more efficient and more aesthetically pleasing poolside burner. With reference to the drawings, FIG. 1 depicts a front perspective view of an embodiment of a poolside burner 100 that produces a controlled flame by igniting a mix of fuel gas such as acetylene, natural gas, or propane and an oxidizer such as the ambient air or supplied oxygen. Some implementations of the presently disclosed poolside burner 100 may include a center feed design in which the gas is supplied to a burner ring 20 through a feeder tube 60 that comes up through the center of a burner plate 10. The feeder tube 60 may connect with a center distribution tube 30, which may distribute the gas to the burner ring 20. The cross-sections of the feeder tube 60, center distribution tube 30, and burner ring 20 may be square, circular, rectangular, or any other shape. Feeding the gas up through the center of the burner plate 10 and then distributing it may help lead the gas to be more evenly distributed around the burner ring 20. In addition, embodiments of a poolside burner 100 with a center feed design may have burner plates 10 that are interchangeable between different burner sizes. For example, a burner plate 10 that is used for a nine-inch burner ring 20 could also be used for an eighteen-inch burner ring because the hole or opening for the feeder tube 60 may be located in the same or approximately the same centralized location on the burner plate 10.

Figure 2:
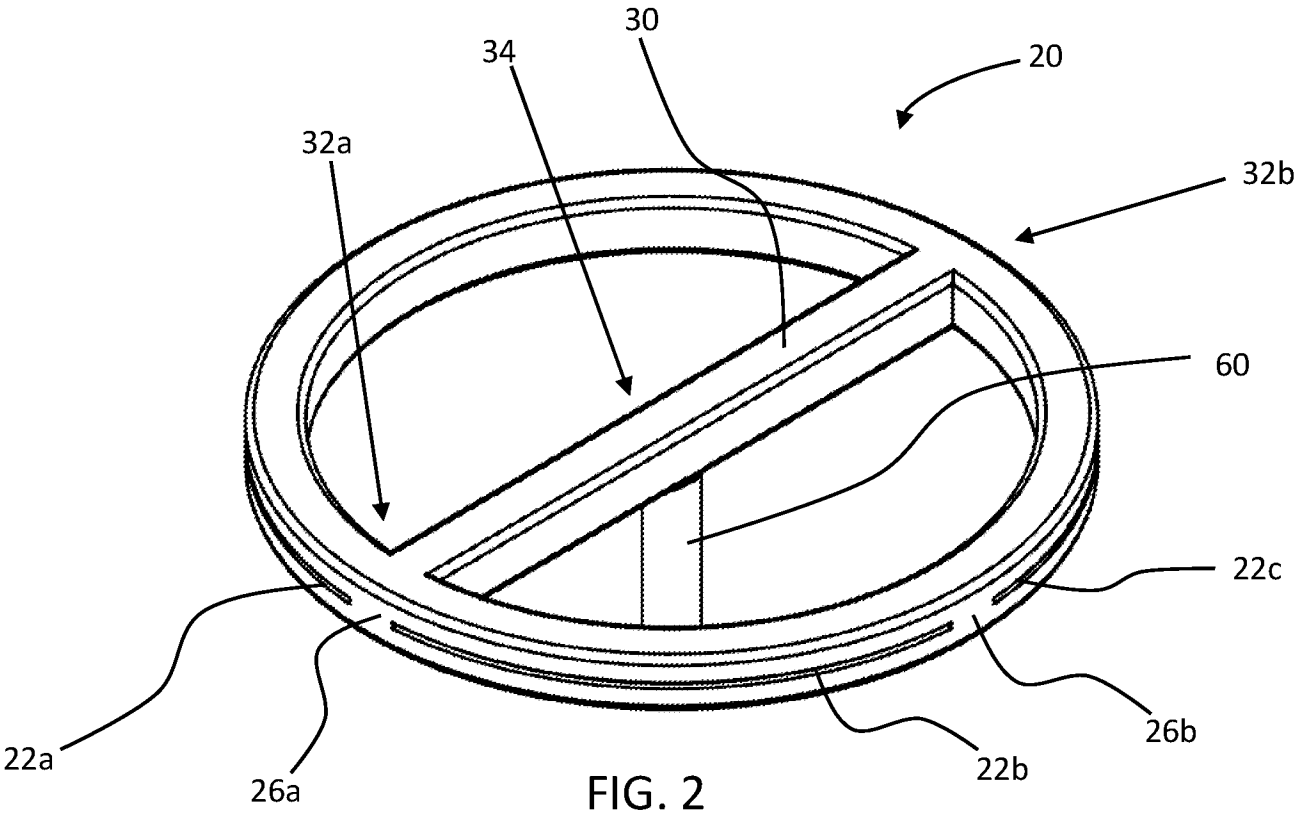
FIG. 2 is a front perspective view of an embodiment of a burner ring and connected central gas feed.

With continued reference to the drawings, as illustrated in FIG. 2, embodiments of a burner ring 20 may have one or more flame orifices 22, such as slit-like flame orifices 22*a-c*. In certain embodiments, each slit-like flame orifice 22 may be divided from the others by a vertical walled section 26 that crosses, or otherwise resides between the slit-like flame orifices 22. Moreover, embodiments of a poolside burner 100 may have a gas feeder tube 60 that is connected to the center distribution tube 30 at a location proximate a lengthwise middle 34 of the center distribution tube 30. One or more vertical walled sections 26, such as vertical walled sections 26*a* and 26*b*, may be placed strategically around the burner ring 20 to aid in the even distribution of gas around the burner ring 20, as well as provide structural support for the burner ring 20. For example, a vertical walled section 26*a* and/or 26*b* may be located at each mouth of the center distribution tube 30, where the opposing distal ends 32*a* and 32*b* of the center distribution tube 30 connect to the burner ring 20. Such a configuration may facilitate the deflection of gas exiting or otherwise emanating from the center distribution tube 30 so that the gas does not all exit the burner ring 20 through slit-like orifices 22 positioned near that location. Instead, the gas may be deflected to travel around the burner ring 20, thus more evenly distributing itself and thereby providing a more realistic-looking and efficiently burning flame, when the poolside burner 100 is operated.

Figure 3:
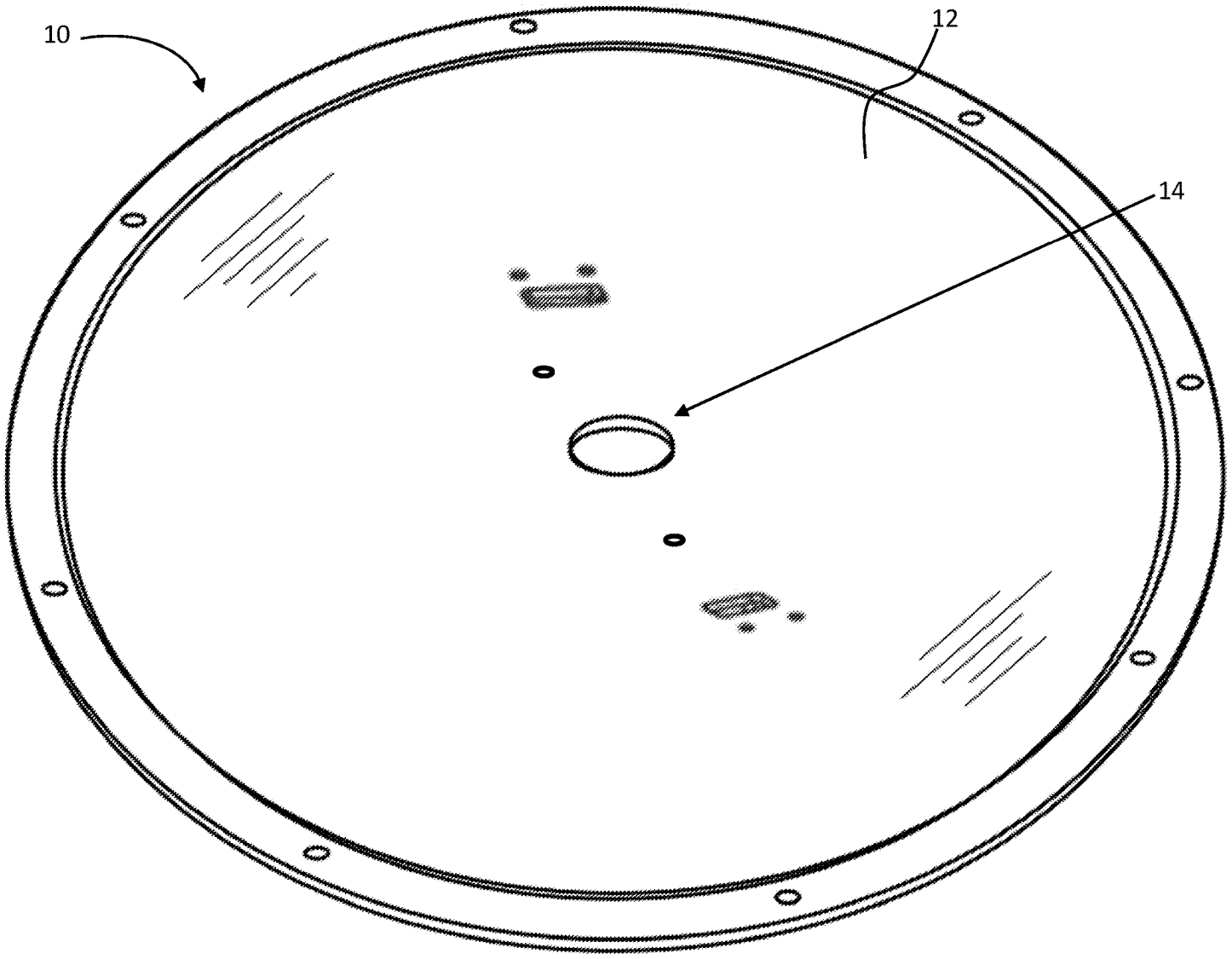
FIG. 3 is a front perspective view of an embodiment of a burner plate having a central gas feed opening.
Figure 4:
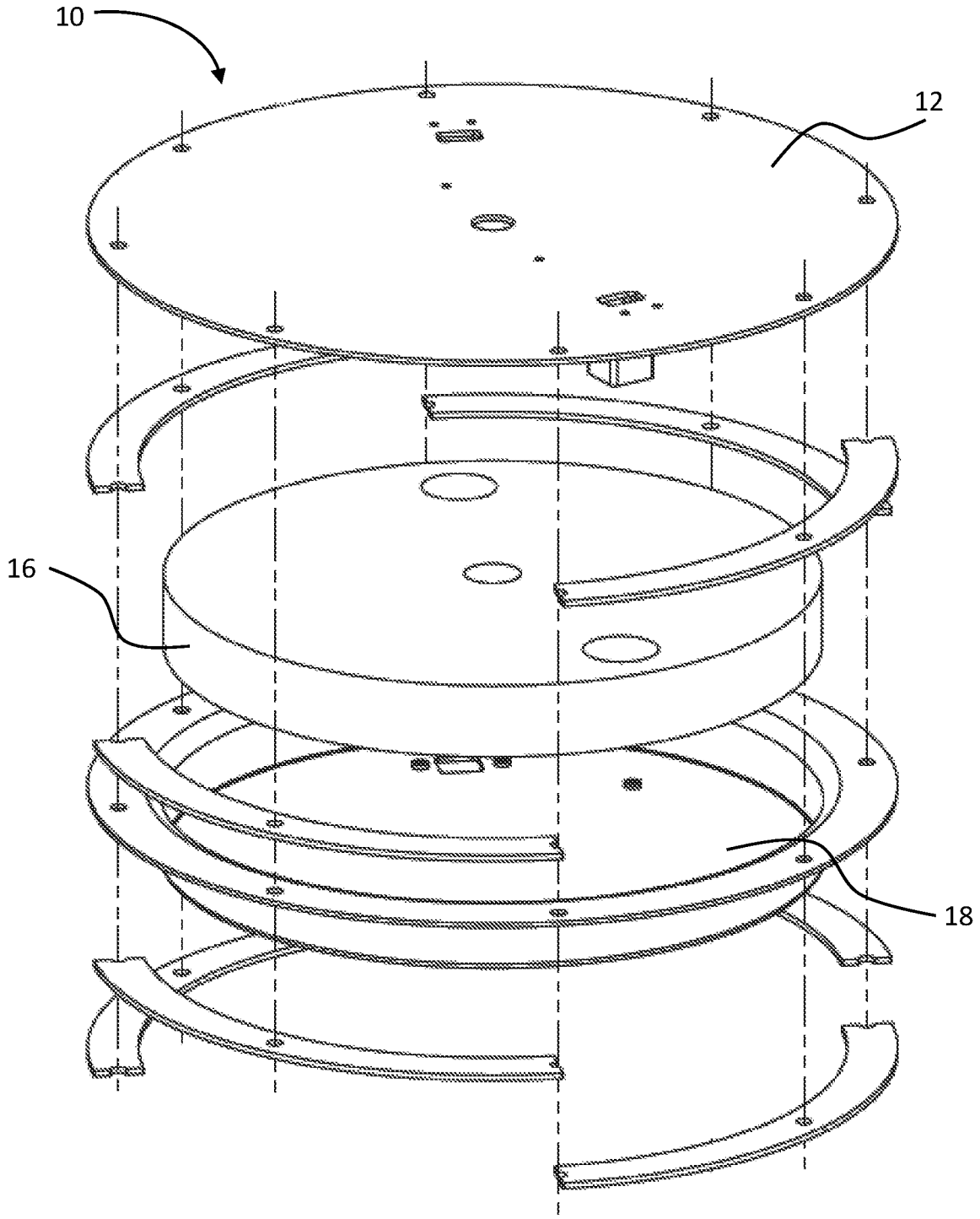
FIG. 4 is an exploded front perspective view of an embodiment of a burner plate.

Turning now to FIG. 3, a front perspective view of an embodiment of a burner plate 10 having a central gas feed opening 14 is depicted. The burner plate 10 on which the burner ring 20 sits, or is otherwise securely attached to, may house one or more layers of insulation which may help protect potentially implemented electronic hardware that may be located on the bottom side of the burner plate 10 from the heat of the flames emanating from the burner ring 20 proximate the top side of the burner plate 10. Additionally, FIG. 4 illustrates an exploded view of a burner plate implementation containing a ceramic fiber board insulating layer 16. Embodiments of a burner plate 10 may comprise a multi-layered burner plate 10 having a top metallic layer 12, a bottom metallic layer 18, and at least one layer of insulating material 16, such as the ceramic fiber board, sandwiched between the top metallic layer 12 and the bottom metallic layer 18.

Multi-layered burner plate 10 embodiments may include an opening 14 located at a symmetrical center of the multi-layered burner plate 10, wherein the symmetrically-centered opening 14 may extend through all layers of the multi-layered burner plate 10. Other burner plate implementations may include other materials to provide insulation. A gas feeder tube 60 may be positioned to extend through the symmetrically-centered opening 14 of the multi-layered burner plate 10, wherein a valve (not shown), possibly positioned on the bottom of the burner plate 10, may control, or otherwise help regulate, gas entry into the feeder tube 60 and eventually the burner ring 20. Portions of the burner plate 10 may be comprised of stamped metal to form the top and bottom cover layers 12 and 18 that house the insulating layer 16. The various layers of a multi-layered burner plate 10 may incorporate press-fit nuts to mount parts and assemblies thereon, and/or may utilize conventional self-tapping screws.

Embodiments of a burner ring 20 may be secured to or positioned in relation to the burner plate 10 in a manner wherein a bottom portion of the burner ring 20 is positioned near the top metallic layer 12 of the multi-layered burner plate 10. A top portion of the burner ring 20 may be located at a farthest extent from the top metallic layer 12 of the multi-layered burner plate 10. Furthermore, an inside portion of the burner ring 20 may be oriented to face the center distribution tube. Still further, an outside portion of the burner ring 20 may be located or otherwise be existent opposite the inside portion of the burner ring 20 and may be the radially outermost portion of the burner ring 20. The slit-like flame orifice(s) 22 may be positioned longitudinally along the radially outside portion of the burner ring 20, so that the general extent of the slit-like flame orifice(s) runs in a direction oriented longitudinally along the radially outermost portion of the burner ring 20. In addition, the slit-like flame orifice(s) 22 may be located and configured so that flame extends substantially perpendicularly from the slit-like flame orifice(s) 22 after the gas emanating from the flame orifice(s) 22 is ignited and the poolside burner 100 is lit and brought to operational condition. Burner ring 20 embodiments may be symmetrically polygonal-shaped, or may be circular-shaped.

Figure 5:
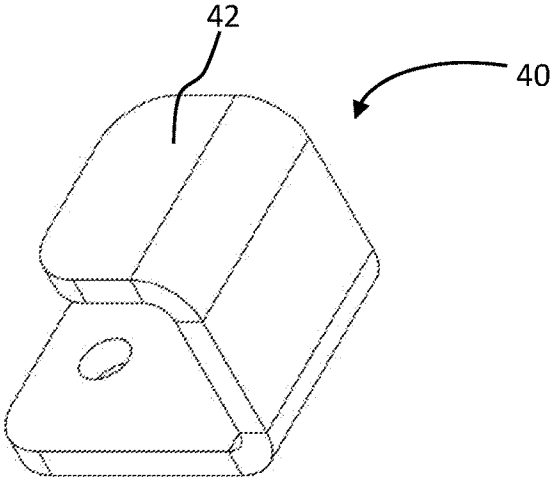
FIG. 5 is a side perspective view of an embodiment of a retaining bracket.

With continued reference to the drawings, FIG. 5 depicts a perspective view of a bracket 40 that may be utilized to help couple or otherwise secure a burner ring 20 to a burner plate 10. It is noted that, instead of utilizing an attachment implement that extends directly up from the burner plate 10 and only restricts the burner ring against horizontal movement, some embodiments of the present disclosure may utilize a one or more brackets 40 which are configured to wrap around the top of the center distribution tube 30. Such wrap brackets 40 may attach the burner ring 20 more securely to the burner plate 10. A wrap bracket embodiment 40 may be coupled to the plate with a screw or with a nut and bolt run through the hole shown. The center distribution tube 30 may then be inserted into the bracket(s) 40 (see FIG. 1). The multiple wrap brackets 40 may be configured to allow the burner ring 20 to rotate into place, with each wrap bracket 40 having an opening facing a different direction depending on which side of the center distribution tube 30 the bracket 40 is placed.

Embodiments of a wrap bracket 40 may have a lip or wrap portions 42 configured to wrap around and restrain a portion of the center distribution tube 30. Where a plurality of wrap brackets 40 is employed, the brackets 40 may be mounted in a manner wherein one of the wrap brackets 40*a* wraps around a side of the center distribution tube 30 and the other of the wrap brackets 40*b* wraps around an opposite side of the center distribution tube 30. The bracket(s) 40 may, at least partially, wrap around the center distribution tube 30 and be removably securely attached to the burner plate 10.

While embodiments of a poolside burner 100 may operate with a pilot light to help ignite the burner flame, some other implementations of a poolside burner 100 may not use a pilot light, but rather may be re-lit, as necessary, each time the poolside burner 100 is used or if the flame goes out. Such non-pilot-light embodiments may limit the gas that is spent to keep a pilot light lit and may simplify the components needed for operation of the burner. Conventional poolside burners often have two valves on the bottom side of the plate, one for the pilot light and one for the burner ring. Poolside burner 100 embodiments that do not utilize a pilot light may require only one valve, thereby saving space on the bottom side of the burner plate 10, reducing manufacturing costs, and creating a smaller device profile.

As discussed previously, conventional poolside burners that must be relit often consume significant amounts of power because of the requirements of hot surface ignition. Some embodiments of the presently disclosed poolside burner 100 instead implement direct spark ignition ("DSI"). In DSI, a spark is used to ignite the gas. This spark may be produced in a variety of ways. FIG. 5 illustrates a direct spark igniter 70 embodiment which produces a spark for gas ignition. Some implementations of the present disclosure run a low-power DC voltage through a transistor and coil with a small number of turns which is aligned with a coil with a large number of turns. The transistor is suddenly switched to off. This sudden change in the current through the small coil causes a sudden change in the magnetic field produced by that current. The sudden change in the magnetic field induces a very high voltage in the large coil by Faraday's law, and this high voltage produces a spark which ignites the gas. Igniting the burner with a spark from a direct spark igniter 70 may consume much less power than hot surface ignition. In addition, DSI may require fewer parts, have a simpler design, and use hardware that is more robust and less sensitive to weather. An embodiment of a direct spark igniter 70 may be located so that a spark emanating from the igniter 70 extends near at least one slit-like flame orifice 22 to ignite gas permeating from the orifice 22 and light the poolside burner 100. Moreover, the direct spark igniter 70 may be located proximate where an end 32*a* or 32*b* of the center distribution tube 30 connects to the burner ring 20 and where gas from the center distribution tube 30 initially permeates through a nearest slit-like flame orifice 22.

With regard to various embodiments of a poolside burner 100, a direct current ("DC") power supply may be used instead of an alternating current ("AC") power supply. This DC power supply may be a 12-volt power supply. This DC power supply feature may be possible because DSI can be implemented with a DC power supply, while hot surface ignition commonly requires an AC power supply. A DC power supply may have several benefits, including lower power consumption, cheaper hardware, more readily available sourcing, easier installment, and a smaller and more compact form factor. In addition, an AC power supply may sometimes buzz or click during the operation of the hot surface ignition, while a DC power supply may have silent valve and electronics operation Embodiments of a poolside burner 100 may include a flame sensor (not shown) positioned to detect whether there is an active flame emanating from the burner ring 20. In particular implementations of the present disclosure, instead of being located next to a pilot light or a direct spark igniter 70, a flame sensor may located directly adjacent to the main burner ring 20. FIG. 1 illustrates such an implementation, where the flame sensor resides within a cage 50*a* and the direct spark igniter and/or pilot light is housed within a cage 50*b*. The flame sensor may be located separate from the direct spark igniter 70 along the outside portion of the burner ring 20 and near at least one slit-like flame orifice 22. The flame sensor may be configured to detect if there is a flame projecting from the slit-like flame orifice. With the flame sensor separated from the ignition and/or pilot light, the sensor may be able to get a more accurate reading on whether the poolside burner 100 is lit because there may be no other hardware present to interfere with the reading. Therefore, such a flame sensor configuration may limit situations where the flame sensor misreads the burner and signals for a restart when there is not a need, thus saving on power that would otherwise be wasted. As further illustrated in FIG. 1, the direct spark igniter may be located proximate where the gas exits the center distribution tube 30. However, as discussed above, some implementations place a vertical walled section 26 at the mouth of the center distribution tube 30 to aid in the distribution of the gas around the burner ring 20. Therefore, some implementations may include a hole in the vertical walled section 26 to allow a small amount of gas to exit the burner ring into the ignition cage 50. This may aid in igniting the gas as it begins to fill the burner ring 20.

Figure 7:
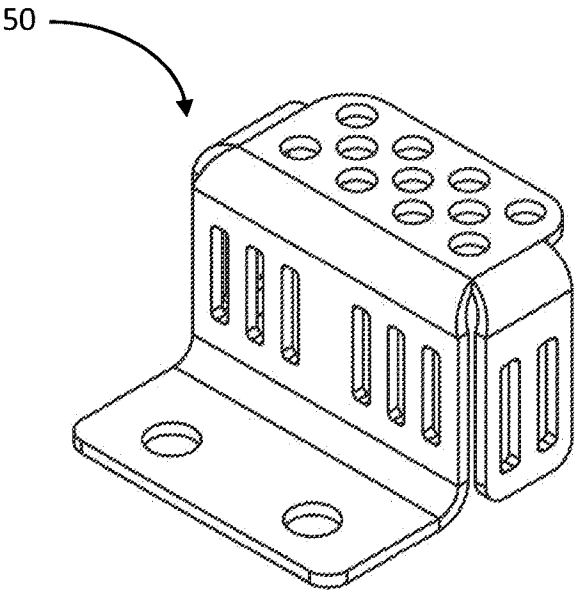
FIG. 7 is a front perspective view of an embodiment of a flame sensor/ignition cage.
Figure 6:
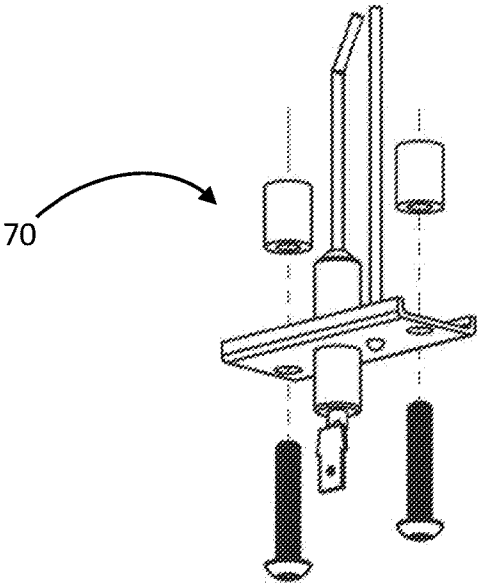
FIG. 6 is an exploded front perspective view of an embodiment of a direct spark igniter.

Referring still further to the drawings, FIG. 7 depicts a front perspective view of an embodiment of a flame sensor/ignition cage 50. Particular implementations of the presently disclosed poolside burner 100 may include cages 50 that enclose the ignition and/or flame sensor. Fire media, such as decorative fire glass, rolled lava stone, lava rock, or river rock, are often placed on top of the poolside burner and can interfere with the successful operation of the ignition or flame sensor. Therefore, a cage, such as cages 50*a* and 50*b*, may limit the interference of the fire media by providing a barrier between the fire media and the ignition or flame sensor. In addition, a cage 50 may provide a controlled environment for the ignition and flame sensor to function properly. This is especially useful for the flame sensor, for which the cage 50 may act as a wind break limiting the effect of the wind in bending the flames away from the flame sensor. This may reduce potential false "flame out" occurrences in which the burner may attempt to restart the flame unnecessarily. Embodiments having a plurality of cages 50 may include one cage 50*a* that may be secured to the multi-layered burner plate 10 and located so as to be positioned around the direct spark igniter 70 and partially surround the direct spark igniter 70 and the other cage 50 may be secured to the multi-layered burner plate 10 and located so as to be positioned around and partially surround the flame sensor.

Some implementations may alter the process through which the poolside burner is manufactured. For example, a poolside burner is conventionally manufactured through sand casting, however, the present disclosure may contemplate the manufacture of various parts of the poolside burner 100 through metal injection molding and/or sintering processes. Some implementations of a poolside burner 100 may include parts and hardware that are corrosion resistant and may be treated for long life in weather. For example, stainless steel parts may be passivated, aluminum parts may be painted, and electrical connections may be housed, crimped, and/or heat-shrunk for long life connections.

It will be understood that poolside burner 100 embodiments are not limited to the specific components disclosed herein, as virtually any components consistent with the intended operation of the various poolside burner 100 implementations may be utilized. Accordingly, for example, it should be understood that, while the drawings and accompanying text show and describe particular poolside burner 100 implementations, any such implementation may comprise any shape, size, style, type, model, version, class, grade, measurement, concentration, material, weight, quantity, and/or the like consistent with the intended operation of poolside burner 100 implementations.

The concepts disclosed herein are not limited to the specific poolside burner implementations shown herein. For example, it is specifically contemplated that the components included in particular poolside burner implementations may be formed of any of many different types of materials or combinations that can readily be formed into shaped objects and that are consistent with the intended operation of the poolside burner implementations. For example, the components may be formed of: rubbers (synthetic and/or natural) and/or other like materials; glasses (such as fiberglass), carbon-fiber, aramid-fiber, any combination thereof, and/or other like materials; polymers such as thermoplastics (such as ABS, Fluoropolymers, Polyacetal, Polyamide; Polycarbonate, Polyethylene, Polysulfone, and/or the like), thermosets (such as Epoxy, Phenolic Resin, Polyimide, Polyurethane, Silicone, and/or the like), any combination thereof, and/or other like materials; composites and/or other like materials; metals, such as zinc, magnesium, titanium, copper, iron, steel, carbon steel, alloy steel, tool steel, stainless steel, spring steel, aluminum, any combination thereof, and/or other like materials; alloys, such as aluminum alloy, titanium alloy, magnesium alloy, copper alloy, any combination thereof, and/or other like materials; any other suitable material; and/or any combination of the foregoing.

Furthermore, poolside burner 100 implementations may be manufactured separately and then assembled together, or any or all of the components may be manufactured simultaneously and integrally joined with one another. Manufacture of these components separately or simultaneously, as understood by those of ordinary skill in the art, may involve extrusion, pultrusion, vacuum forming, injection molding, blow molding, resin transfer molding, casting, forging, cold rolling, milling, drilling, reaming, turning, grinding, stamping, cutting, bending, welding, soldering, hardening, riveting, punching, plating, and/or the like. If any of the components are manufactured separately, they may then be coupled or removably coupled with one another in any manner, such as with adhesive, a plastic weld, a fastener, any combination thereof, and/or the like for example, depending on, among other considerations, the particular material(s) forming the components.

Where the above examples, embodiments and implementations reference examples, it should be understood by those of ordinary skill in the art that other helmets and manufacturing methods and examples could be intermixed or substituted with those provided. In places where the description above refers to particular embodiments of poolside burner implementations and associated methodology, it should be readily apparent that a number of modifications may be made without departing from the spirit thereof and that these embodiments and implementations may be applied to other to poolside burner assembly methods and functionality as well. The presently disclosed poolside burner implementations are, therefore, to be considered in all respects as illustrative and not restrictive. Accordingly, the disclosed subject matter is intended to embrace all such alterations, modifications and variations that fall within the spirit and scope of the disclosure and the knowledge of one of ordinary skill in the art

What is claimed is:

1. A poolside burner comprising:

a multi-layered burner plate having a top metallic layer, a bottom metallic layer, and at least one layer of insulating material sandwiched between the top metallic layer and the bottom metallic layer, wherein the multi-layered burner plate includes an opening located at a symmetrical center of the multi- layered burner plate, wherein the symmetrically-centered opening extends through all layers of the multi-layered burner plate;

a gas feeder tube positioned to extend through the symmetrically-centered opening of the multi-layered burner plate, wherein a valve controls gas entry into the feeder tube;

a center distribution tube connected to the gas feeder tube at a location proximate a lengthwise middle of the center distribution tube;

a burner ring connected to the center distribution tube at opposing distal ends of the center distribution tube, wherein a bottom portion of the burner ring is positioned near the top metallic layer of the multi-layered burner plate, a top portion of the burner ring is located at a farthest extent from the top metallic layer of the multi-layered burner plate, an inside portion of the burner ring is oriented to face the center distribution tube, and an outside portion of the burner ring is located opposite the inside portion of the burner ring, wherein the burner ring includes:

at least two flame orifices located on the outside portion of the burner ring, wherein the at least two flame orifices are slit-like and configured so that the general extent of each of the at two slit-like flame orifices runs in a direction oriented longitudinally along the outside portion of the burner ring; and at least two vertical walled sections located on the outside portion of the burner ring, wherein the at least two vertical walled sections are separately positioned between the at least two slit- like flame orifices;

at least two wrap brackets, each of the at least two wrap brackets being configured to securely attach to the multi-layered burner plate and wrap around and restrain a portion of the center distribution tube in a manner wherein one of the at least two wrap brackets wraps around a side of the center distribution tube and the other of the at least two wrap brackets wraps around an opposite side of the center distribution tube;

a direct spark igniter, located so that a spark emanating from the igniter extends near one of the at least two slit-like flame orifices to ignite gas permeating from the orifice and light the burner;

a flame sensor, located separate from the direct spark igniter along the outside portion of the burner ring and near one of the at least two slit-like flame orifices, wherein the flame sensor is configured to detect if there is a flame projecting from the slit-like flame orifice near the flame sensor;

at least two cages, wherein one cage of the at least two cages is secured to the multi- layered burner plate and located so as to be positioned around the direct spark igniter and the other cage of the at least two cages is secured to the multi-layered burner plate and located so as to be positioned around the flame sensor.

2. The poolside burner of claim 1, wherein the center distribution tube and the burner ring are comprised of square tubing having a square-like cross-section.

3. The poolside burner of claim 1, wherein the center distribution tube and the burner ring are comprised of circular tubing having a circular cross-section.

4. The poolside burner of claim 1, wherein the burner ring is a polygonal-shaped having an even number of sides.

5. The poolside burner of claim 1, wherein the burner ring is circular-shaped.

6. The poolside burner of claim 1, wherein at least one of the at least two vertical walled sections is located on the outside portion of the burner ring at a position proximate where an end of the center distribution tube connects to the burner ring.

7. The poolside burner of claim 1, wherein the valve that controls gas entry into the feeder tube is located on a bottom side of the multi-layered burner plate.

8. The poolside burner of claim 1, wherein the direct spark igniter is located proximate where an end of the center distribution tube connects to the burner ring and where gas from the center distribution tube initially permeates through a nearest slit-like flame orifice.

9. The poolside burner of claim 1 further comprising a pilot light.

10. A poolside burner comprising:

a burner ring connected to opposite ends of a center distribution tube, wherein the center distribution tube is connected to a feeder tube that extends through a central opening of a burner plate to which the burner ring is secured by a bracket that, at least partially, wraps around the center distribution tube and is attached to the burner plate;

a direct spark igniter positioned near a slit-like flame orifice of the burner ring running longitudinally about a portion of an outside surface of the burner ring, wherein the slit-like flame orifice is located and configured so that flame extends substantially perpendicularly from the slit-like flame orifice after the direct spark igniter lights the poolside burner;

a flame sensor positioned near a portion of the slit-like flame orifice separate from the direct spark igniter and configured to sense whether a flame is permeating from the slit-like flame orifice after the direct spark igniter lights the poolside burner; and two cages, wherein one of the two cages partially surrounds the direct spark igniter and the other of the two cages partially surrounds the flame sensor.

11. The poolside burner of claim 10, wherein the burner plate is comprised of multiple layers, wherein one of the layers is formed of an insulating material.

12. The poolside burner of claim 10, wherein the central opening of the burner plate is centered symmetrically with respect the configuration of the burner plate.

13. The poolside burner of claim 10 further comprising a plurality of slit-like flame orifices, wherein a respective number of vertical walled sections are separately positioned between each of the slit-like flame orifices of the plurality of slit-like flame orifices.

14. The poolside burner of claim 10 further comprising at least one more bracket, wherein the at least one more bracket at least partially, wraps around the center distribution tube and is attached to the burner plate.

15. A poolside burner comprising:

a burner plate having a layer of insulating material sandwiched between top and bottom metallic layers, wherein the burner plate includes an opening that extends through all layers of the burner plate;

a gas feeder tube positioned to extend through the opening of the burner plate;

a center distribution tube connected to the gas feeder tube;

a burner ring connected to the center distribution tube at opposing distal ends of the center distribution tube, wherein the burner ring includes:

a slit-like flame orifice located on a radially outermost portion of the burner ring, wherein the slit-like flame orifice is positioned longitudinally along the radially outermost portion of the burner ring; and a vertical walled section located on the radially outermost portion of the burner ring;

a wrap bracket configured to attach to the burner plate and restrain a portion of the center distribution tube;

a direct spark igniter, located to ignite gas permeating from the slit-like flame orifice; and a flame sensor, located separate from the direct spark igniter along the slit-like flame orifice;

wherein at least a portion of the vertical walled portion is located on the radially outermost portion of the burner ring proximate a location where the center distribution tube connects to the burner ring to facilitate deflection of gas emanating from the center distribution tube so that the gas travels around the burner ring and more evenly distributes itself throughout the burner ring prior to permeation from the slit-like flame orifice.

16. The poolside burner of claim 15, further comprising a plurality of slit-like flame orifices positioned longitudinally along the radially outermost portion of the burner ring.

17. The poolside burner of claim 15, further comprising a valve configured to control a flow of gas into the gas feeder tube.

18. The poolside burner of claim 10, wherein the center distribution tube and the burner ring are comprised of square tubing having a square-like cross-section.

19. The poolside burner of claim 10, wherein the burner ring is a polygonal-shaped.

20. The poolside burner of claim 10, wherein the burner ring is circular-shaped.

* * * * *